US011879685B2

(12) United States Patent
Hirose

(10) Patent No.: US 11,879,685 B2
(45) Date of Patent: Jan. 23, 2024

(54) HIGH-PURITY OXYGEN PRODUCTION SYSTEM

(71) Applicant: L'Air Liquide, Societe Anonyme pour l'Etude et l'Exploitation des Procedes Georges Claude, Paris (FR)

(72) Inventor: Kenji Hirose, Kobe (JP)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 355 days.

(21) Appl. No.: 17/023,290

(22) Filed: Sep. 16, 2020

(65) Prior Publication Data

US 2021/0080171 A1 Mar. 18, 2021

(30) Foreign Application Priority Data

Sep. 18, 2019 (JP) ..... 2019-169055

(51) Int. Cl.
*F25J 1/00* (2006.01)
*F25J 3/04* (2006.01)

(52) U.S. Cl.
CPC ..... *F25J 1/0017* (2013.01); *F25J 1/0012* (2013.01); *F25J 1/0015* (2013.01); *F25J 3/04024* (2013.01); *F25J 3/04442* (2013.01); *F25J 2200/00* (2013.01); *F25J 2210/40* (2013.01); *F25J 2210/42* (2013.01); *F25J 2210/50* (2013.01)

(58) Field of Classification Search
CPC ..... F25J 1/0017; F25J 1/0012; F25J 1/0015; F25J 3/04024; F25J 3/04442;
(Continued)

(56) References Cited

U.S. PATENT DOCUMENTS 3,375,673 A * 4/1968 Cimler ..... F25J 3/04393 62/651
5,341,646 A * 8/1994 Agrawal ..... F25J 3/04351 62/646
(Continued)

FOREIGN PATENT DOCUMENTS

JP 3929799 6/2007
JP 3929799 B2 * 6/2007 ..... F25J 3/08
(Continued)

*Primary Examiner* — Miguel A Diaz
*Assistant Examiner* — Ibrahim A. Michael Adeniji
(74) *Attorney, Agent, or Firm* — Justin K. Murray

(57) ABSTRACT

Certain embodiments of the present invention lies in providing a high-purity oxygen production system which is capable of supplying liquid nitrogen in order to supply the cold required by a high-purity oxygen production apparatus, without the use of a costly conventional liquefaction apparatus.

A high-purity oxygen production system in accordance with an embodiment can include: an air separation apparatus including a main heat exchanger, a medium-pressure column and a low-pressure column; and a high-purity oxygen production apparatus including a nitrogen compressor, a nitrogen heat exchanger and at least one (high-purity) oxygen rectification column, an oxygen-containing stream serving as a starting material for high-purity oxygen is supplied from the low-pressure column to the high-purity oxygen production apparatus, and liquid nitrogen obtained from the medium-pressure column is supplied to the high-purity oxygen production apparatus in order to replenish cold heat required for operation of the high-purity oxygen production apparatus.

7 Claims, 5 Drawing Sheets

(58) Field of Classification Search
CPC .. F25J 2200/00; F25J 2210/40; F25J 2210/42; F25J 2210/50; F25J 2200/50; F25J 3/08; F25J 2245/90; F25J 2290/62; F25J 3/04224; F25J 3/04315; F25J 3/04351; F25J 3/04357; F25J 2200/34; F25J 2220/50; F25J 2220/52; F25J 3/0409; F25J 2200/20; F25J 2215/56; F25J 3/04412; F25J 3/0403; F25J 2200/04; F25J 2215/42; F25J 2215/50; F25J 3/04048; F25J 3/0423; F25J 3/04321; F25J 2245/50
See application file for complete search history.

(56) References Cited

U.S. PATENT DOCUMENTS 5,582,032 A * 12/1996 Shelton ..... F25J 3/08 62/643
5,778,698 A * 7/1998 Yamamoto ..... F25J 3/04169 62/652
6,327,873 B1 * 12/2001 Dray ..... F25J 3/04745 62/925
2010/0071412 A1 * 3/2010 Parsnick ..... F25J 3/04254 62/651
2013/0053998 A1 * 2/2013 Singhal ..... F25J 3/04303 700/108
2014/0318179 A1 * 10/2014 Ha ..... F25J 3/04448 62/643
2020/0182543 A1 * 6/2020 Hirose ..... F25J 3/0409

FOREIGN PATENT DOCUMENTS

JP 6427359 11/2018
JP 2018-204825 12/2018
JP 2018204825 A * 12/2018 ..... F25J 3/04066

* cited by examiner

HIGH-PURITY OXYGEN PRODUCTION SYSTEM

CROSS REFERENCE TO RELATED APPLICATIONS

This application claims the benefit of priority under 35 U.S.C. § 119 (a) and (b) to Japanese patent application No. JP2019-169055, filed Sep. 18, 2019, the entire contents of which are incorporated herein by reference.

FIELD OF THE INVENTION

The present invention relates to a system for producing high-purity oxygen.

BACKGROUND OF THE INVENTION

There is a demand for high-purity oxygen that does not contain high-boiling-point components such as hydrocarbons for the semiconductor industry, etc. In order to produce this high-purity oxygen, there are methods in which liquid oxygen obtained from an air separation apparatus comprising a medium-pressure column and a low-pressure column has impurities removed therefrom by means of at least one rectification column, as described in Patent Documents 1 (JP 3929799 B2) and 2 (JP 6427359 B2), for example.

In those methods for obtaining high-purity oxygen by rectifying liquid oxygen, it is efficient to supply liquid nitrogen in order to maintain a heat balance in the process, and it is generally the case that this liquid nitrogen is directly supplied from a nitrogen liquefaction cycle or supplied from a remote facility using a tanker lorry or the like.

Patent Document 3 indicates that, in the case of high-purity oxygen for semiconductor production processes, etc., the high-purity oxygen is fed by means of a pressurization apparatus combining a tank and a pressurizer, rather than by means of a mechanical pump, in order to avoid contamination with metal components such as copper that would have an adverse effect on said process.

SUMMARY OF THE INVENTION

However, when liquid nitrogen for supply to a high-purity oxygen production apparatus is supplied remotely by a tanker lorry or the like, this involves transportation costs, so it would be more desirable to produce liquid nitrogen at the site where the high-purity oxygen is produced. In this case, there is a known method, such as described in Patent Document 2, where nitrogen obtained from an air separation apparatus is liquefied by means of a liquefaction cycle produced by a compressor, a heat exchanger and an expansion turbine. That method makes it possible to reduce the costs involved in transportation of liquid nitrogen, but a costly liquefaction apparatus is required, while at the same time a large amount of energy is consumed because of the operations in which low-pressure nitrogen obtained from the air separation apparatus is compressed to a high pressure in a compressor, and decompressed by an expansion valve or an expansion turbine.

Furthermore, in the method of Patent Document 3 (JP 2018-204825 A), a pressurization apparatus is temporarily isolated from a high-purity oxygen rectification process and high-purity oxygen is pressurized and fed out, after which the inside of a tank is depressurized and refilled with high-purity oxygen liquid from the high-purity oxygen rectification process. The high-purity oxygen gas which is released during depressurization is recovered in a high-purity oxygen rectification column or preferably re-liquefied by means of a condenser, but either case requires a supply of liquid nitrogen which is needed in order to re-liquefy the high-purity oxygen gas, and there is a temporary increase in demand for liquid nitrogen.

When liquid nitrogen is supplied from a medium-pressure column of the air separation apparatus, the increased amount of liquid nitrogen which is drawn out for a time leads to a problem in terms of a relative reduction in a reflux liquid supplied to a low-pressure column of the air separation apparatus, and this has an adverse effect on rectification in the low-pressure column.

In light of the situation described above, the aim of the present invention lies in providing a high-purity oxygen production system which is capable of supplying liquid nitrogen in order to supply the cold required by a high-purity oxygen production apparatus, without the use of a costly conventional liquefaction apparatus.

A further aim of the present invention lies in providing a high-purity oxygen production system which is capable of supplying liquid nitrogen without generating a large pressure loss, by utilizing the fact that the pressure of liquid nitrogen obtained from a medium-pressure column is close to the operating pressure of the high-purity oxygen production apparatus.

A further aim of the present invention lies in providing a high-purity oxygen production system in which an air separation apparatus (Air Separation Unit; referred to below as an "ASU") and a high-purity oxygen production apparatus (Ultra Pure Oxygen Plant) are combined, oxygen supplied from the ASU is purified by the high-purity oxygen production apparatus, and a cold heat balance in the high-purity oxygen production apparatus can be maintained by means of nitrogen supplied from the ASU.

A high-purity oxygen production system according to the present invention comprises: an air separation apparatus including a main heat exchanger, a medium-pressure column and a low-pressure column; and a high-purity oxygen production apparatus including a nitrogen compressor, a nitrogen heat exchanger and at least one (high-purity) oxygen rectification column, wherein an oxygen-containing stream serving as a starting material for high-purity oxygen is supplied from the low-pressure column to the high-purity oxygen production apparatus, and liquid nitrogen obtained from the medium-pressure column is supplied to the high-purity oxygen production apparatus in order to replenish cold heat required for operation of the high-purity oxygen production apparatus.

By virtue of this configuration, it is possible to supply liquid nitrogen in order to supply the cold required by the high-purity oxygen production apparatus, without the use of a costly conventional liquefaction apparatus. Furthermore, the pressure of the liquid nitrogen obtained from the medium-pressure column is close to an operating pressure of the high-purity oxygen production apparatus, so it is possible to supply liquid nitrogen without generating a large pressure loss, which is efficient.

In certain embodiments, the air separation apparatus (A1) can include:

- a main heat exchanger (1) for subjecting starting material air (Feed air) to heat exchange;
- a medium-pressure column (2) to which the starting material air that has passed through the main heat exchanger (1) is introduced, the medium-pressure column (2) having a medium-pressure column bottom (21) in which a first rectification liquid (oxygen-rich liquid)

is collected, a medium-pressure column rectification portion (22) for rectifying the starting material air, and a medium-pressure column top (23) arranged above the medium-pressure column rectification portion (22); and a low-pressure column (4) arranged above the medium-pressure column (2), the low-pressure column (4) having a low-pressure column bottom (41) inside or below which is arranged a nitrogen condenser (3) for condensing a gas drawn from the medium-pressure column top (23) and conducted by a circulation line (L6) and in which a second rectification liquid (oxygen-containing stream) is collected, a low-pressure column rectification portion (42) for rectifying the first rectification liquid (oxygen-rich liquid) drawn from the medium-pressure column bottom (21) (by introducing the first rectification liquid at a first intermediate stage after heat exchange in a heat exchanger (sub-cooler (5)), and a low-pressure column top (43) to which is introduced at least a portion of a condensed stream (comprising condensed liquid nitrogen (enriched state) or nitrogen (enriched state) gas, or a mixed state thereof) condensed in the nitrogen condenser (3) (after said portion has undergone heat exchange in the heat exchanger (sub-cooler (5) via a line (L621)).

In another embodiment, the high-purity oxygen production apparatus (A2) may include:

a first oxygen rectification column (7) having: a first oxygen rectification column rectification portion (72) to which the second rectification liquid drawn from the low-pressure column bottom (41) is introduced at an intermediate portion thereof or therebelow, a first oxygen rectification column bottom (71) arranged below the first oxygen rectification column rectification portion (72), and a first oxygen rectification column top (73) arranged above the first rectification column rectification portion (72);

a first oxygen evaporator (8) arranged inside or below the first oxygen rectification column bottom (71), the first oxygen evaporator (8) causing evaporation of a rectification liquid falling from the first oxygen rectification column rectification portion (72) and the second rectification liquid (oxygen-containing stream) which has been introduced;

a first oxygen condenser (9) arranged inside or above the first oxygen rectification column top (73), wherein a first oxygen rectification gas drawn from an upper portion of the first oxygen rectification column rectification portion (72) is cooled and liquefied by first liquid nitrogen condensed in the first oxygen evaporator (8), and is returned to the first oxygen rectification column rectification portion (72);

a second oxygen rectification column (10) having a second oxygen rectification column bottom (101), a second oxygen rectification column rectification portion (102) arranged above the second oxygen rectification column bottom (101), and a second oxygen rectification column top (103) arranged above the second oxygen rectification column rectification portion (102);

a second oxygen evaporator (11) arranged inside or below the second oxygen rectification column bottom (101), the second oxygen evaporator (11) causing evaporation of a rectification liquid falling from the second oxygen rectification column rectification portion (102);

a second oxygen condenser (12) arranged inside or above the second oxygen rectification column top (103), wherein the second oxygen condenser (12) cools and liquefies a second oxygen rectification gas drawn from an upper portion of the second oxygen rectification column rectification portion (102) by means of second liquid nitrogen sent to the second oxygen condenser (12), and returns the cooled and liquefied gas to the second oxygen rectification column rectification portion (102);

a nitrogen heat exchanger (13) to which is introduced a nitrogen-rich gas drawn from a space (1031) above the second oxygen condenser (12) in the second oxygen rectification column top (103);

a nitrogen compressor (14) for compressing the nitrogen-rich gas drawn from the nitrogen heat exchanger (13);

a line (L12) for recirculating a compressed nitrogen-rich gas compressed in the nitrogen compressor (14) to the nitrogen heat exchanger (13), and introducing the nitrogen-rich gas to a space (711) below the first oxygen evaporator (8) in the first oxygen rectification column bottom (71); and a branch line (L121) which branches from the line (L12) and introduces the nitrogen-rich gas to a space (1011) below the second oxygen evaporator (11) in the second oxygen rectification column bottom (101).

At least a portion of a condensed stream (comprising condensed liquid nitrogen (enriched state) or nitrogen (enriched state) gas, or a mixed state thereof) condensed in the nitrogen condenser (3) may be introduced into the space (1011).

High-purity oxygen (UPO) may be drawn from the second oxygen rectification column bottom (101) or the second oxygen evaporator (11) via a line L13.

Furthermore, the high-purity oxygen production apparatus (A2) may comprise:

a high-purity oxygen tank (15) for storing high-purity oxygen (UPO) extracted in a liquid;

a pressurizer (or a pumpless evaporator) (16) for evaporating a portion of high-purity liquid oxygen and pressurizing the high-purity liquid oxygen; and a liquid nitrogen buffer (17) for storing liquid nitrogen.

The liquid nitrogen buffer (17) corresponds to the space (1011) in the second oxygen rectification column bottom (101), but may be arranged on a line L62.

Fluid exchange with the high-purity oxygen production apparatus side is preferably controlled by a valve so that pressurization operations afforded by the pressurizer are carried out batchwise.

Liquid nitrogen for supplying the cold heat required to liquefy and recover the high-purity oxygen gas generated when the high-purity oxygen tank (15) is depressurized is stored in the liquid nitrogen buffer (17).

By virtue of this configuration, it is possible to draw liquid nitrogen from the medium-pressure column (2) with a weighted average flow rate of the liquid nitrogen required for the high-purity oxygen production process and the liquid nitrogen required for re-liquefying the high-purity oxygen released when the high-purity oxygen tank is depressurized, and fluctuations in demand for liquid nitrogen can be met by the liquid nitrogen buffer (17), which makes it possible to recover high-purity oxygen during depressurization while eliminating adverse effects on rectification in the air separation apparatus (A1).

Furthermore, the high-purity oxygen production apparatus (A2) may include:

a line (L62) for supplying liquid nitrogen from the medium-pressure column (2) of the air separation apparatus (A1) to the liquid nitrogen buffer (17);

a liquid nitrogen flowmeter (300) which is provided on the line (L62) and measures a flow rate of liquid nitrogen; and a control valve (301) for controlling an amount measured by the liquid nitrogen flowmeter (300) to a predetermined amount or a predetermined range.

When there is a fluctuation in demand for liquid nitrogen in the high-purity oxygen production apparatus (A2), the control valve (301) is controlled in such a way as to supply a constant liquid nitrogen stream.

Furthermore, the high-purity oxygen production apparatus (A2) may comprise:

a flowmeter or a height level gauge (liquid surface gauge LS1) for measuring an amount in the liquid nitrogen buffer (17) stored in the space (1011) in the second oxygen rectification column bottom (101), and may be provided with a first control valve (301) for controlling an amount measured by the flowmeter or the height level gauge (liquid surface gauge LS1) to a predetermined amount or a predetermined range.

When there is a fluctuation in demand for liquid nitrogen in the high-purity oxygen production apparatus (A2), the first control valve (301) is controlled in such a way as to supply a constant liquid nitrogen stream.

The first control valve (301) may be controlled by utilizing either one or both of a result measured by the flowmeter or the height level gauge (LS1) and a result measured by the liquid nitrogen flowmeter (300), in such a way that constant liquid nitrogen can be supplied when there is a fluctuation in demand for liquid nitrogen in the high-purity oxygen production apparatus (A2).

By virtue of this configuration, it is possible to stably supply liquid nitrogen to the high-purity oxygen production apparatus even if there is a load fluctuation in either the air separation apparatus (A1) or the high-purity oxygen production apparatus (A2).

Furthermore, the high-purity oxygen production apparatus (A2) may comprise:

a flowmeter or a height level gauge (liquid surface gauge LS2) for measuring an amount of liquid nitrogen in the second oxygen condenser (12); and a second control valve (304) which is provided in the line L11 and controls an amount measured by the flowmeter or the height level gauge (liquid surface gauge LS2) to a predetermined amount or a predetermined range.

When there is a fluctuation in demand for liquid nitrogen in the second oxygen condenser (12), the second control valve (304) is controlled in such a way as to satisfy insufficiency in the liquid nitrogen demand.

Furthermore, in the high-purity oxygen production system, a high-purity oxygen liquid pressurized in the high-purity oxygen tank (15) may be introduced (via a line L142) to the main heat exchanger (1) in the air separation apparatus (A1) and evaporated, and extracted as high-purity oxygen gas.

A buffer (401) for temporarily storing the pressurized high-purity oxygen liquid may be provided in the line L142.

By virtue of this configuration, it is possible to recover the cold released when the high-purity oxygen liquid is evaporated, leading to improved thermal efficiency. Here, the reason for which the high-purity oxygen liquid is particularly evaporated in the main heat exchanger (1) of the air separation apparatus (A1), rather than in the heat exchanger of the high-purity oxygen production apparatus (A2) is that the high-purity oxygen liquid can be evaporated by means of sensible heat of process air serving as a heat source. If the high-purity oxygen liquid were evaporated in the heat exchanger of the high-purity oxygen production apparatus (A2), then nitrogen cycle gas in the high-purity oxygen production apparatus (A2) would serve as a heat source, but not only sensible heat but also latent heat would be required, and at least a portion of the nitrogen cycle gas would be liquefied. The liquefied nitrogen cycle gas does not contribute to the high-purity oxygen rectification process as a reboiling source, and therefore constitutes a process loss.

Furthermore, in the high-purity oxygen production system, a nitrogen expansion line (L50) may be provided in the nitrogen cycle of the high-purity oxygen production apparatus (A2) in such a way as to supply cold heat to the high-purity oxygen production apparatus (A2).

The nitrogen expansion line (L50) may constitute a circulation pathway which branches and leads out from the middle of the nitrogen heat exchanger (13) in the line L12 that is introduced into the nitrogen heat exchanger (13) after the nitrogen compressor (14), merging with the line L12 between the nitrogen heat exchanger (13) and the space (1031) in the second oxygen rectification column top (103).

A nitrogen expansion mechanism (18) such as a valve or a turbine may also be provided on the nitrogen expansion line (L50).

By virtue of this configuration, it is possible to replenish cold by means of the nitrogen cycle when there is insufficient cold in the high-purity oxygen production apparatus.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims the way in which said claims refer back to one another.

DETAILED DESCRIPTION OF THE INVENTION

Several modes of embodiment of the present invention will be described below. The modes of embodiment described below illustrate examples of the present invention. The present invention is in no way limited by the following modes of embodiment and also includes a number of variant modes implemented within a scope that does not alter the essential point of the present invention. It should be noted that not all of the constituent elements described below are necessarily essential to the present invention.

Mode of Embodiment 1

Figure 1:
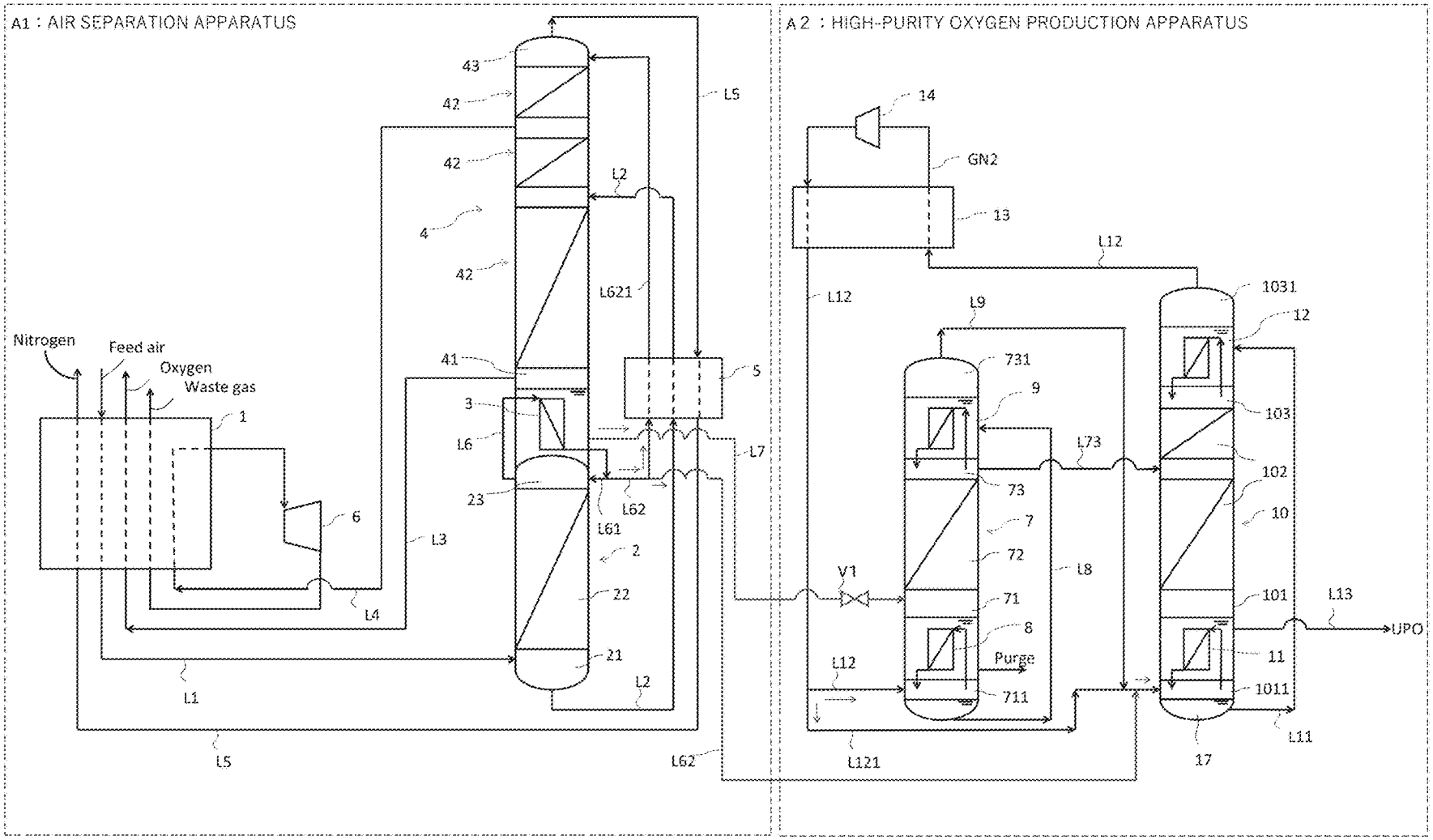
FIG. 1 shows a high-purity oxygen production system according to Mode of Embodiment 1.

A high-purity oxygen production system according to Mode of Embodiment 1 will be described with the aid of FIG. 1.

The high-purity oxygen production system according to the present invention comprises: a separation apparatus A1, and a high-purity oxygen production apparatus A2 including two (high-purity) oxygen rectification columns. The air separation apparatus A1 comprises: a main heat exchanger 1, a medium-pressure column 2, a nitrogen condenser 3, a low-pressure column 4, a sub-cooler 5, and an expansion turbine 6. The high-purity oxygen production apparatus A2 comprises: a first oxygen rectification column 7, a first oxygen evaporator 8, a first oxygen condenser 9, a second oxygen rectification column 10, a second oxygen evaporator 11, a second oxygen condenser 12, a nitrogen heat exchanger 13, and a nitrogen compressor 14.

The air separation apparatus A1 will be described first of all.

Starting material air (Feed air) passes through the main heat exchanger 1 via a starting material air introduction line L1 and is supplied to a medium-pressure column bottom 21 of the medium-pressure column 2.

The medium-pressure column 2 comprises: the medium-pressure column bottom 21 in which a first rectification liquid (oxygen-rich liquid) is collected, a medium-pressure column rectification portion 22 for rectifying the starting material air, and a medium-pressure column top 23 arranged above the medium-pressure column rectification portion 22.

A low-pressure column 4 is arranged above the medium-pressure column 2.

The low-pressure column 4 comprises: a low-pressure column bottom 41 in which an oxygen-containing stream is collected, a low-pressure column rectification portion 42 arranged thereabove, and a low-pressure column top 43 arranged thereabove.

The low-pressure column bottom 41 is internally provided with a nitrogen condenser 3 for condensing a gas drawn from the medium-pressure column top 23 and conducted by a circulation line L6.

The low-pressure column rectification portion 42 rectifies the first rectification liquid (oxygen-rich liquid) drawn from the medium-pressure column bottom 21 by introducing the first rectification liquid at a first intermediate stage after heat exchange in the sub-cooler 5.

The low-pressure column top 43 has introduced therein at least a portion of a condensed stream (comprising condensed liquid nitrogen (enriched state) or nitrogen (enriched state) gas, or a mixed state thereof) condensed in the nitrogen condenser 3 after said portion has undergone heat exchange in the sub-cooler 5 via a line L621.

A line L2 is a line for introducing the first rectification liquid (oxygen-rich liquid) drawn from the medium-pressure column bottom 21 at an intermediate stage of the low-pressure column rectification portion 42 after heat exchange in the sub-cooler 5.

A line L3 is a line for feeding to the main heat exchanger 1 an oxygen-rich gas drawn from an upper region of the low-pressure column bottom 41.

A line L5 is a line for feeding to the main heat exchanger 1 a nitrogen-rich gas drawn from the low-pressure column top 43 after heat exchange in the sub-cooler 5.

A line L4 is a line for introducing exhaust gas drawn from an intermediate stage (a second intermediate stage positioned above the first intermediate stage) of the low-pressure column rectification portion 42 into the main heat exchanger 1, and using said exhaust gas in an expansion turbine 6 after it has been drawn from an intermediate portion of the main heat exchanger 1, then once again feeding the exhaust gas into the main heat exchanger 1.

A circulation line L6 which leads out from the nitrogen condenser 3 branches into a first branch line L61 returning to the medium-pressure column top 23, and a second branch line L62 which leads into the second oxygen rectification column 10 of the high-purity oxygen production apparatus A2. A third branch line L621 branches from the second branch line L62 and introduces at least a portion of the condensed stream into the low-pressure column top 43 after heat exchange in the sub-cooler 5.

The high-purity oxygen production apparatus A2 will be described next.

The first oxygen rectification column 7 comprises: a first oxygen rectification column rectification portion 72 to which a second rectification liquid drawn from the low-pressure column bottom 41 is introduced at an intermediate portion thereof or therebelow, a first oxygen rectification column bottom 71 arranged below the first oxygen rectification column rectification portion 72, and a first oxygen rectification column top 73 arranged above the first rectification column rectification portion 72.

The second rectification liquid (oxygen-containing stream) drawn from the low-pressure column bottom 41 is introduced into the first oxygen rectification column bottom 71 above the first oxygen evaporator 8 via a line L7.

A first oxygen rectification liquid (oxygen-rich liquid) drawn from the first oxygen rectification column bottom 71 is introduced into the first oxygen rectification column top 73 via a line L8.

The first oxygen evaporator 8 is arranged inside or below the first oxygen rectification column bottom 71. The first oxygen evaporator 8 causes evaporation of a rectification liquid falling from the first oxygen rectification column rectification portion 72 and the second rectification liquid (oxygen-containing stream) which has been introduced.

The first oxygen condenser 9 is arranged inside or above the first oxygen rectification column top 73. The first oxygen condenser 9 cools and liquefies a first oxygen rectification gas drawn from an upper portion of the first oxygen rectification column rectification portion 72 by means of first liquid nitrogen drawn from the first oxygen evaporator 8 via the line L8, and returns the cooled and liquefied gas to the first oxygen rectification column rectification portion 72.

The second oxygen rectification column 10 comprises: a second oxygen rectification column bottom 101, a second oxygen rectification column rectification portion 102 arranged thereabove, and a second oxygen rectification column top 103 arranged thereabove.

At least a portion of a condensed stream (comprising condensed liquid nitrogen (enriched state) or nitrogen (enriched state) gas, or a mixed state thereof) condensed in the nitrogen condenser 3 is introduced into the second oxygen rectification column bottom 101 in a space (1011) below the second oxygen evaporator 11 via the second branch line L62.

The second oxygen rectification column rectification portion 102 has an intermediate stage to which the first oxygen rectification gas drawn from the upper portion of the first oxygen rectification column rectification portion 72 is introduced via a line L73.

The second oxygen evaporator 11 is arranged inside or below the second oxygen rectification column bottom 101. The second oxygen evaporator 11 causes evaporation of a rectification liquid falling from the second oxygen rectification column rectification portion 102.

The second oxygen condenser 12 is arranged inside or above the second oxygen rectification column top 103. The second oxygen condenser 12 cools and liquefies a second oxygen rectification gas drawn from an upper portion of the second oxygen rectification column rectification portion 102 by means of second liquid nitrogen drawn from the second oxygen rectification column bottom 101 via a line L11, and returns the cooled and liquefied gas to the second oxygen rectification column rectification portion 102.

The nitrogen heat exchanger 13 has introduced therein, via a line L12, a nitrogen-rich gas drawn from a space 1031 above the second oxygen condenser 12 in the second oxygen rectification column top 103, and heat exchange is performed therein.

The nitrogen compressor 14 compresses the nitrogen-rich gas drawn from the nitrogen heat exchanger 13.

Additionally, the line L12 is a line by which a compressed nitrogen-rich gas compressed in the nitrogen compressor 14 is once again made to pass through the nitrogen heat exchanger (13), and introduced into a space 711 below the first oxygen evaporator 8 in the first oxygen rectification column bottom 71.

A branch line L121 is a line which branches from the line L12 and introduces the nitrogen-rich gas to a space 1011 below the second oxygen evaporator 11 in the second oxygen rectification column bottom 101.

The line L7 is a line by which the second rectification liquid (oxygen-containing stream) is drawn from the low-pressure column bottom 41. A valve V1 such as a gate valve, a flow rate regulating valve, or a pressure regulating valve is provided in the line L7.

The line L8 is a line for feeding the first liquid nitrogen (first liquid nitrogen buffer) drawn from the space 711 in the first oxygen rectification column bottom 71 for use as cold heat in the first oxygen condenser 9.

The line L73 is a line for introducing the first oxygen rectification gas drawn from the upper portion of the first oxygen rectification column rectification portion 72 at an intermediate stage of the second oxygen rectification column rectification portion 102.

A line L9 is a line for introducing a gas drawn from a space 731 above the first oxygen condenser 9 in the first oxygen rectification column top 73 into the space 1011 below the second oxygen evaporator 11 in the second oxygen rectification column bottom 101.

The line L11 is a line for feeding the second liquid nitrogen (second liquid nitrogen buffer 17) drawn from the space 1011 in the second oxygen rectification column bottom 101 for use as cold heat in the second oxygen condenser 12.

A line L13 is a line for extracting high-purity oxygen (UPO) from the second oxygen rectification column bottom (101) or the second oxygen evaporator (11).

Valves (gate valves, flow rate regulating valves, pressure regulating valves, etc.) may be provided in the abovementioned lines.

Mode of Embodiment 2

Figure 2:
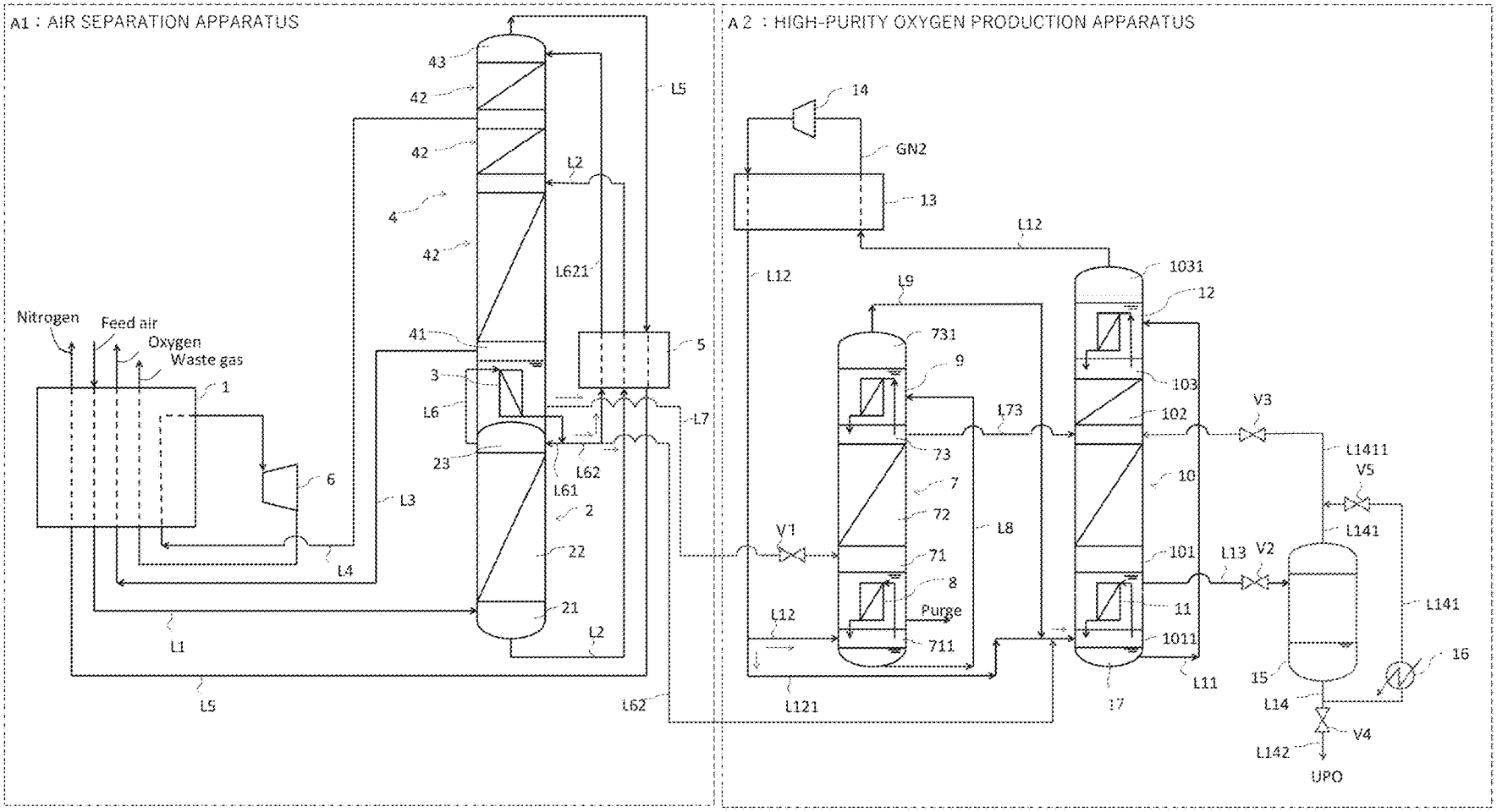
FIG. 2 shows a high-purity oxygen production system according to Mode of Embodiment 2.

A high-purity oxygen production system according to Mode of Embodiment 2 will be described with the aid of FIG. 2. Constituent elements which are different from those of FIG. 1 according to Mode of Embodiment 1 will be described, and the description of constituent elements which are the same will be omitted or simplified.

The high-purity oxygen production apparatus A2 comprises: a high-purity oxygen tank 15 for storing high-purity oxygen (UPO) extracted in a liquid; a pressurizer 16 for evaporating a portion of high-purity liquid oxygen and pressurizing the high-purity liquid oxygen; and a liquid nitrogen buffer 17 for storing liquid nitrogen. The liquid nitrogen buffer 17 corresponds to the space 1011 below the second oxygen rectification column bottom 101.

The high-purity oxygen tank 15 has introduced therein the high-purity oxygen (UPO) drawn from the second oxygen rectification column bottom 101 or the second oxygen evaporator 11 via the line L13.

The pressurizer (or pumpless evaporator) 16 draws the high-purity oxygen (UPO) from a lower portion or bottom portion of the high-purity oxygen tank 15 via a line L141, evaporates at least a portion of the high-purity liquid oxygen, and pressurizes the high-purity liquid oxygen.

The line L13 is connected to an upper portion of the high-purity oxygen tank 15 and is provided with a valve V2 (a gate valve, flow rate regulating valve, or pressure regulating valve, etc.).

The line L141 branches from a line L14 which is connected to the lower portion or bottom portion of the high-purity oxygen tank 15, and is provided with a valve V5 (a gate valve, flow rate regulating valve, or pressure regulating valve, etc.). The line L141 is a line for introducing at least a portion of the high-purity liquid oxygen to the pressurizer (16) and the high-purity oxygen tank (15).

A line L142 is a line which branches from the line L14 and serves to extract high-purity liquid oxygen.

A line L1411 is a line which branches from the line L141 and serves to introduce the pressurized high-purity liquid oxygen to an intermediate portion of the second oxygen rectification column rectification portion 102.

The line L1411 and the line L142 are provided with valves (V3, V4) (gate valves, flow rate regulating valves, pressure regulating valves, etc.).

Valve operations are controlled in the following manner in this system.

(1) When high-purity oxygen (UPO) is introduced to the high-purity oxygen tank 15 via the line L13, the valves V4, V5 are closed and the valves V2, V3 are opened.

(2) When the high-purity liquid oxygen pressurized in the pressurizer 16 is returned to the high-purity oxygen tank 15 via the line L141, the valves V2, V3, V4 are closed and the valve V5 is opened.

(3) When the high-purity liquid oxygen pressurized in the pressurizer 16 is introduced into the intermediate portion of the second oxygen rectification column rectification portion 102 via the line L1411, the valves V2, V4, V5 are closed and the valve V3 is opened. According to this configuration, the tank cannot be filled by a pressure difference, the product is not discharged, and pressurization does not occur.

(4) When the high-purity liquid oxygen is extracted via the line L142, the valves V2, V3 are closed and the valves V4, V5 are opened. It is necessary to continue pressurization via the valve V5 because discharge of the product causes decompression in proportion to the amount by which the contents of the tank decrease.

Mode of Embodiment 3

Figure 3:
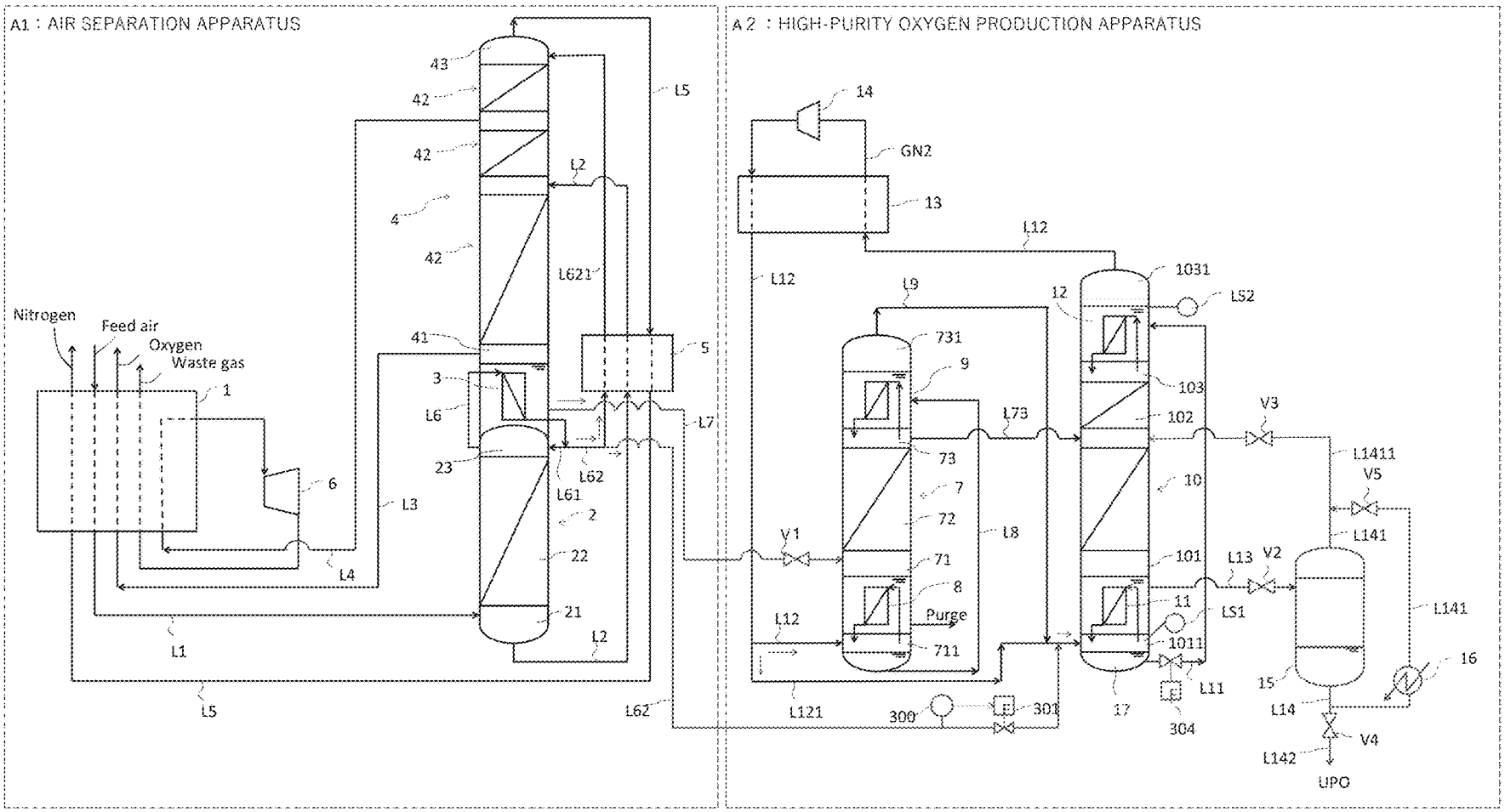
FIG. 3 shows a high-purity oxygen production system according to Mode of Embodiment 3.

A high-purity oxygen production system according to Mode of Embodiment 3 will be described with the aid of FIG. 3. Constituent elements which are different from those of Modes of Embodiment 1 and 2 (FIGS. 1 and 2) will be described, and the description of constituent elements which are the same will be omitted or simplified.

The high-purity oxygen production apparatus A2 comprises: a line L62 for supplying liquid nitrogen from the medium-pressure column 2 of the air separation apparatus A1 to the liquid nitrogen buffer 17; a liquid nitrogen flowmeter 300 which is provided on the line L62 and measures a flow rate of liquid nitrogen; and a control valve 301 for controlling an amount measured by the liquid nitrogen flowmeter 300 to a predetermined amount or a predetermined range.

Furthermore, the high-purity oxygen production apparatus A2 comprises a flowmeter or a height level gauge LS1 for measuring an amount of liquid nitrogen in the liquid nitrogen buffer 17 stored in the space 1011 in the second oxygen rectification column bottom 101.

A first control valve 301 is controlled by utilizing either one or both of a result measured by the flowmeter or the height level gauge LS1 and a result measured by the liquid nitrogen flowmeter 300, in such a way that constant liquid nitrogen can be supplied when there is a fluctuation in demand for liquid nitrogen in the high-purity oxygen production apparatus A2.

By virtue of this configuration, it is possible to stably supply liquid nitrogen to the high-purity oxygen production apparatus even if there is a load fluctuation in either the air separation apparatus A1 or the high-purity oxygen production apparatus A2.

Furthermore, the high-purity oxygen production apparatus A2 comprises: a flowmeter or a height level gauge LS2 for measuring an amount of liquid nitrogen in the second oxygen condenser 12; and a second control valve 304 which is provided in the line L11 and controls an amount measured by the flowmeter or the height level gauge LS2 to a predetermined amount or a predetermined range. As a result, when there is a fluctuation in demand for liquid nitrogen in the second oxygen condenser 12, the second control valve 304 is controlled in such a way as to satisfy insufficiency in the liquid nitrogen demand.

Mode of Embodiment 4

Figure 4:
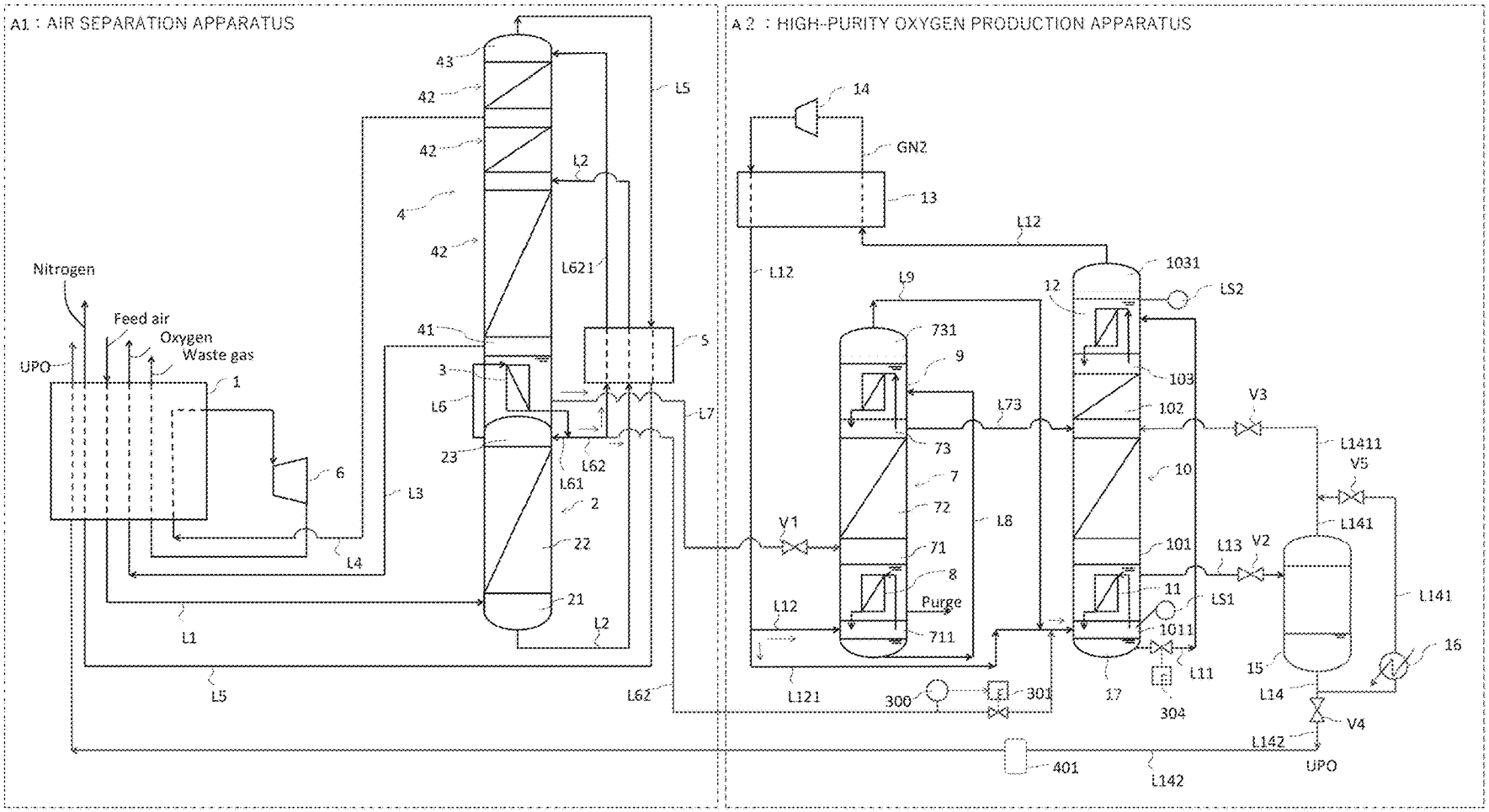
FIG. 4 shows a high-purity oxygen production system according to Mode of Embodiment 4.

A high-purity oxygen production system according to Mode of Embodiment 4 will be described with the aid of FIG. 4. Constituent elements which are different from those of Modes of Embodiment 1, 2 and 3 (FIGS. 1, 2 and 3) will be described, and the description of constituent elements which are the same will be omitted or simplified.

In the high-purity oxygen production system, a high-purity oxygen liquid pressurized in the high-purity oxygen tank 15 is introduced via the line L142 to the main heat exchanger 1 in the air separation apparatus A1 and evaporated, and extracted as high-purity oxygen gas.

A buffer 401 for temporarily storing the pressurized high-purity oxygen liquid may be provided in the line L142.

Mode of Embodiment 5

Figure 5:
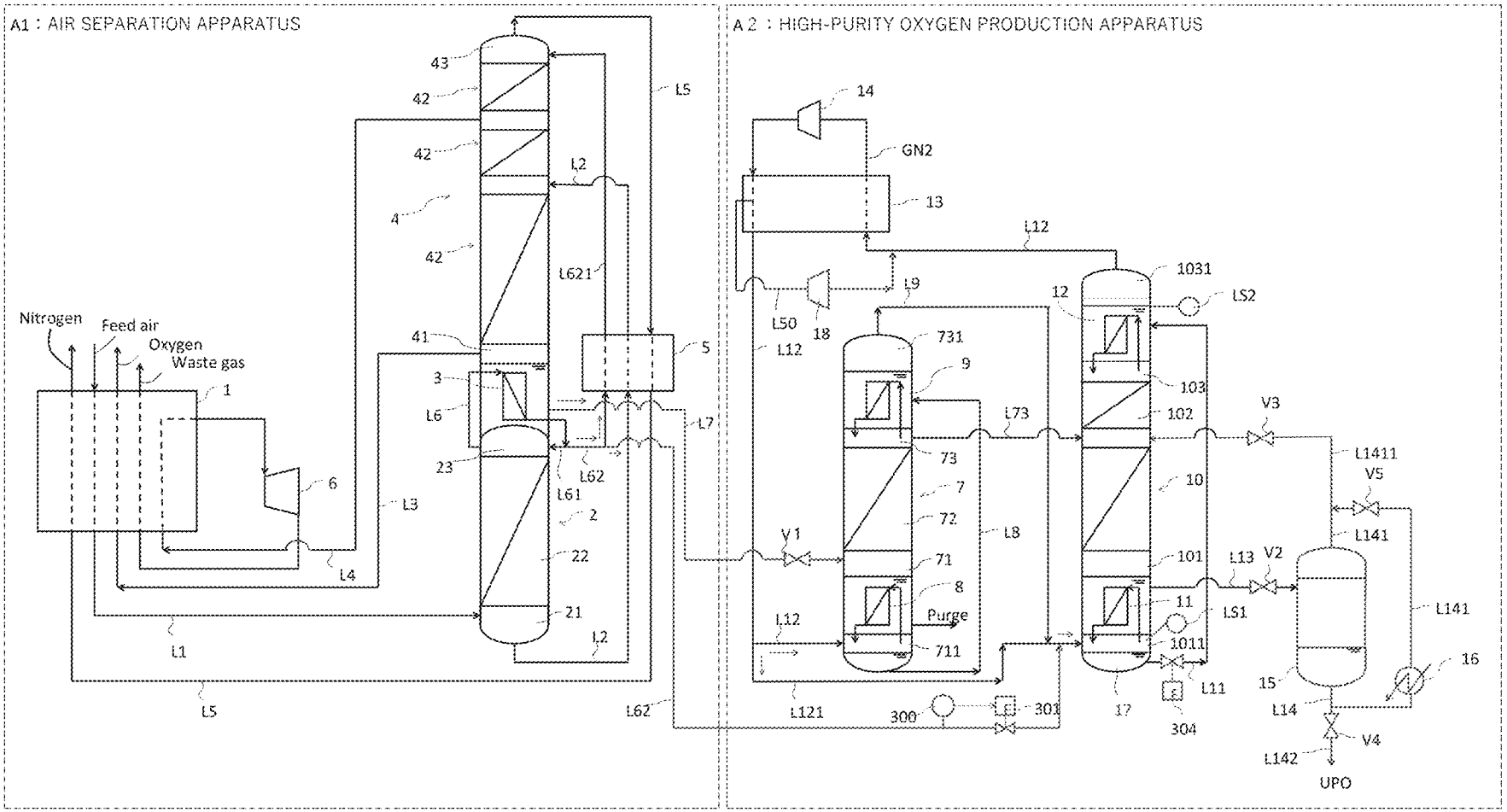
FIG. 5 shows a high-purity oxygen production system according to Mode of Embodiment 5.

A high-purity oxygen production system according to Mode of Embodiment 5 will be described with the aid of FIG. 5. Constituent elements which are different from those of Modes of Embodiment 1, 2 and 3 (FIGS. 1, 2 and 3) will be described, and the description of constituent elements which are the same will be omitted or simplified.

In the high-purity oxygen production system, a nitrogen expansion line L50 is provided in a nitrogen cycle of the high-purity oxygen production apparatus A2 in such a way as to supply cold heat to the high-purity oxygen production apparatus A2. The nitrogen expansion line L50 constitutes a circulation pathway which branches and leads out from the middle of the nitrogen heat exchanger 13 in the line L12 that is introduced into the nitrogen heat exchanger 13 after the nitrogen compressor 14, merging with the line L12 between the nitrogen heat exchanger 13 and the space 1031 in the second oxygen rectification column top 103. A nitrogen expansion mechanism 18 such as a valve or a turbine is further provided on the nitrogen expansion line L50.

Exemplary Embodiments

The system according to abovementioned Mode of Embodiment 1 (FIG. 1) will be described more specifically.

Starting material air is supplied to a warm end of a main heat exchanger 1 of an air separation apparatus A1 at a pressure of 9.4 barA, a temperature of 20° C., and a flow rate of 1000 $Nm^3/h$, and after being cooled, the starting material air is supplied to the bottom of a medium-pressure column 2. The medium pressure column 2 is operated at 9.3 barA, and liquid nitrogen is recovered at 418 $Nm^3/h$ from a column top 23 thereof. An oxygen-rich liquid is recovered at 582 $Nm^3/h$ from a column bottom 21 thereof. A nitrogen condenser 3 is provided in an upper region of the medium pressure column 2, nitrogen gas in the medium-pressure column top 23 is condensed using liquid nitrogen supplied from a bottom 41 of a low-pressure column 4 as a refrigerant, and liquid nitrogen is returned to the medium-pressure column top 23.

1.0 $Nm^3/h$ of the liquid nitrogen is supplied to a high-purity oxygen production apparatus A2, and the remaining liquid nitrogen is supplied to a low-pressure column top 43 as a reflux liquid. An oxygen loading liquid is supplied to a low-pressure column intermediate portion 42. The low-pressure column 4 is operated at 2.8 barA, and 7.8 $Nm^3/h$ of liquid nitrogen is recovered from the low-pressure column bottom 41 and supplied to the high-purity oxygen production apparatus A2.

A first oxygen rectification column 7 is intended for removing high-boiling-point components from the oxygen, liquid oxygen is supplied to an intermediate portion or a bottom 71 of the first rectification column 7, and liquid oxygen from which the high-boiling-point components have been removed is recovered at 7.5 $Nm^3/h$ from a column top 73. Liquid oxygen in which the high-boiling-point components are concentrated is discharged at 0.3 $Nm^3/h$ from the bottom 71. The first oxygen rectification column 7 is operated at 2.1 barA. A vapour stream required for rectifying the liquid oxygen inside the first oxygen rectification column is supplied by means of a first oxygen evaporator 8 provided in a lower region of the first oxygen rectification column 7, and nitrogen gas at a pressure of 7.8 barA and a temperature of −173° C. which has been compressed by means of a nitrogen compressor 14 and cooled in a nitrogen heat exchanger 13 is supplied at 32 $Nm^3/h$ as a heating medium and liquefied.

A reflux liquid required for rectifying the liquid oxygen inside the first oxygen rectification column is supplied by means of a first oxygen condenser 9 provided in an upper region of the first oxygen rectification column, and 18.4 $Nm^3/h$ of the liquid nitrogen drawn from the first oxygen evaporator 8 is supplied as a refrigerant therein and evaporated. 13.6 $Nm^3/h$ of liquid nitrogen drawn from the first oxygen evaporator 8 is supplied to the first oxygen condenser 9 as a refrigerant.

A second oxygen rectification column 10 is intended for removing low-boiling-point components from the oxygen, liquid oxygen is supplied to an intermediate portion (102) of the second oxygen rectification column 10, oxygen gas comprising the low-boiling-point components is discharged at 0.3 $Nm^3/h$ from a column top 103, and high-purity liquid oxygen from which the high-boiling-point components have been removed is recovered at 7.2 $Nm^3/h$ from a bottom 101. The second oxygen rectification column 10 is operated at 1.3 barA. A vapour stream required for rectifying the liquid oxygen inside the first oxygen rectification column is supplied by means of a second oxygen evaporator 11 provided in a lower region of the second oxygen rectification column 10, and a mixed stream of nitrogen gas compressed by means of the nitrogen compressor 14 and cooled in the nitrogen heat exchanger 13, and nitrogen gas evaporated in the first oxygen condenser 9 is supplied at a pressure of 5.3 barA, a temperature of −177° C., and a flow rate of 59 $Nm^3/h$ as a heating medium and liquefied.

A reflux liquid required for rectifying the liquid oxygen inside the second oxygen rectification column is supplied by means of a second oxygen condenser 12 provided in an upper region of the second oxygen rectification column, and liquid nitrogen is supplied as a refrigerant at 13.6 $Nm^3/h$ from the first oxygen evaporator 8, at 59 $Nm^3/h$ from the second oxygen evaporator 11, and at 1.0 $Nm^3/h$ from the medium-pressure column 2 of the air separation apparatus A1.

Nitrogen gas evaporated in the second oxygen condenser 12 is compressed in the nitrogen compressor 14 after cold has been released therefrom in the nitrogen heat exchanger 13.

The system according to abovementioned Mode of Embodiment 2 (FIG. 2) will be described more specifically.

A high-purity oxygen liquid produced is supplied at a pressure of 1.3 barA to a high-purity oxygen tank 15. Here, in order to supply the high-purity oxygen at 12.5 barA, for example, the high-purity oxygen tank 15 is filled with a liquid, after which the tank 15 and the high-purity oxygen production apparatus A2 are isolated by an isolation valve, and a portion of the high-purity oxygen liquid is evaporated by means of a pressurizer 16 to which a liquid phase portion and a gas phase portion of the tank 15 are connected, whereby the tank 15 is pressurized to 12.5 barA. The high-purity oxygen liquid is supplied from the pressurized tank 15, after which the tank 15 is decompressed in such a way that the pressure therein becomes lower than the pressure in the second oxygen rectification column 10, in order to refill the tank 15. It should be noted that the decompression may be performed by a method in which gas inside the tank is released to the second oxygen rectification column 10 or by means of a condenser installed inside the tank 15 or connected externally, but in this case the method in which gas is released to the second oxygen rectification column 10 is used.

When a high-purity oxygen liquid at 7.2 $Nm^3/h$ is obtained, as in the example in the first Mode of Embodiment 1, and the liquid is pressurized at one time for 720 minutes and fed out, the following cycle can be envisaged as one example: filling of the tank 15 for 520 minutes, pressurization for 20 minutes, feeding out of the liquid for 60 minutes, and then decompression of the tank for 120 minutes.

In this cycle, high-purity oxygen gas at 2.2 $Nm^3/h$ is released during the decompression, and liquid nitrogen at 2.9 $Nm^3/h$ is required in order to liquefy the gas. When the liquid nitrogen at 1.0 $Nm^3/h$ which is always required for operation of the high-purity oxygen production apparatus A2 is added, the liquid nitrogen demand reaches a total of 3.9 $Nm^3/h$, so if liquid nitrogen is directly supplied from the medium-pressure column 2, the amount of liquid nitrogen supplied to the low-pressure column top 43 temporarily decreases by 2.9 $Nm^3/h$, which adversely affects rectification in the low-pressure column 4.

Accordingly, in the present invention, liquid nitrogen in a weighted average amount of the liquid nitrogen demand in the abovementioned cycle is drawn from the medium-pressure column 2, and the liquid nitrogen buffer 17 is used for buffering the liquid supply amount. In this example, the amount of liquid nitrogen drawn from the medium-pressure column 2 is: (1.0 $Nm^3/h \times 720$ minutes+2.9 $Nm^3/h \times 120$ minutes)÷720 minutes=1.5 $Nm^3/h$.

In Mode of Embodiment 2, the liquid nitrogen buffer 17 is arranged in a lower portion of the second oxygen evaporator 11, but this is not limiting, and it may equally be a buffering vessel positioned intermediately (e.g., in the line L62) between the air separation apparatus A1 and the high-purity oxygen production apparatus A2.

The present invention describes a method for producing liquid oxygen obtained from an air separation apparatus with stable process control and without the use of a costly nitrogen liquefaction apparatus.

The abovementioned liquefaction apparatus constitutes around 20% of the equipment cost in the cost of the air separation apparatus, so the present invention enables a very large cost saving. Furthermore, in terms of energy efficiency also, the method for supplying nitrogen obtained from the medium-pressure column in accordance with the present invention is highly efficient to the extent that there is no pressure loss when nitrogen is decompressed from medium pressure to low pressure inside the air separation apparatus, in comparison with the methods such as described in the prior art documents where low-pressure nitrogen obtained from the air separation apparatus is compressed and liquefied, so it is possible to achieve an energy reduction of 0.05 kWh per 1 $Nm^3$ relating to nitrogen compression. Separating nitrogen from the atmosphere in an air separation apparatus and liquefying the nitrogen in a liquefier requires around 1 kW per 1 $Nm^3$, so the energy efficiency is improved by approximately 5%.

Experimental Data

The superiority of Exemplary Embodiments 1-5 corresponding to Modes of Embodiment 1-5 will be described by comparison with Comparative Example 1.

Comparative Example 1: Patent Document 2 (JP 6427359 B2)

Exemplary Embodiment 1: Mode of Embodiment 1 (FIG. 1)

Exemplary Embodiment 2: Mode of Embodiment 2 (FIG. 2)

Exemplary Embodiment 3: Mode of Embodiment 3 (FIG. 3)

Exemplary Embodiment 4: Mode of Embodiment 4 (FIG. 4)

Exemplary Embodiment 5: Mode of Embodiment 5 (FIG. 5)

Exemplary Embodiment 1 and Comparative Example 1 will be compared. In Comparative Example 1, liquid nitrogen supplied to a high-purity production apparatus is produced by a liquefaction apparatus, whereas in Exemplary Embodiment 1, a medium-pressure column of an air separation apparatus serves as a supply source, thereby achieving a simple equipment configuration while suppressing pressure loss in a nitrogen circuit.

In Exemplary Embodiment 2, as compared to Exemplary Embodiment 1, a high-purity tank and a pressurizer, and then a liquid nitrogen buffer for buffering liquid nitrogen supply are added.

Liquid nitrogen is stored in the liquid nitrogen buffer while constant liquid nitrogen is drawn from the medium-pressure column, and liquid nitrogen is supplied to the second oxygen condenser from the buffer in such a way as to provide for excessive cold required during tank decompression. This is because high-purity oxygen gas released during decompression is supplied to the second rectification column and is substantially re-liquefied in the second oxygen condenser.

In Exemplary Embodiment 3, as compared to Exemplary Embodiment 2, a control valve adapted for flow rate and a flowmeter are provided on a line for supplying liquid nitrogen from the air separation apparatus to the high-purity oxygen production apparatus. Additionally, a refrigerant-side liquid surface gauge for the second oxygen condenser, and a control valve for controlling a liquid nitrogen supply amount while monitoring the liquid level are provided. By this means, the valve can be controlled in such a way as to raise the liquid level of the refrigerant-side liquid surface in such a way as to respond to an increased thermal load in the second oxygen condenser when oxygen released during tank decompression is re-liquefied. A signal from the liquid surface gauge provided in the liquid nitrogen buffer 17 is input to the control valve, whereby it is possible to perform selector control such as to throttle the control valve when the liquid level in the buffer has risen.

In Exemplary Embodiment 4, as compared to Exemplary Embodiment 3, cold heat of the high-purity oxygen liquid can be recovered in the main heat exchanger of the air separation apparatus.

In Exemplary Embodiment 5, as compared to Exemplary Embodiment 4, in the nitrogen cycle in the high-purity oxygen production apparatus, a line is drawn from a cold end side of the nitrogen heat exchanger on a nitrogen compressor discharge line, to the nitrogen heat exchanger cold end side on an intake line of the nitrogen compressor, and an expansion device (valve or turbine) is provided on that line. This constitutes an example of a configuration for supplying cold to the high-purity oxygen production apparatus. Cold can be replenished when liquid nitrogen supplied from the medium-pressure column is insufficient, for example.

Alternative Mode of Embodiment

Pressure regulating devices, and flow rate control devices, etc. may also be provided in each of the lines in order to regulate pressure or adjust the flow rate, although this is not explicitly described.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

KEY TO SYMBOLS

1 . . . Main heat exchanger
2 . . . Medium-pressure column
3 . . . Nitrogen condenser
4 . . . Low-pressure column
5 . . . Sub-cooler
6 . . . Expansion turbine
7 . . . First oxygen rectification column
8 . . . First oxygen evaporator
9 . . . First oxygen condenser
10 . . . Second oxygen rectification column
11 . . . Second oxygen evaporator
12 . . . Second oxygen condenser
13 . . . Nitrogen heat exchanger
14 . . . Nitrogen compressor

We claim:

1. A high-purity oxygen production system comprising:

an air separation apparatus including a main heat exchanger, a medium-pressure column and a low-pressure column; and a high-purity oxygen production apparatus including a nitrogen compressor, a nitrogen heat exchanger and at least one high-purity oxygen rectification column, wherein the low-pressure column is in fluid communication with the high-purity oxygen production apparatus such that the system is configured to supply an oxygen-containing stream serving as a starting material for high-purity oxygen from the low-pressure column to the high-purity oxygen production apparatus, and wherein the medium-pressure column is in fluid communication with the high-purity oxygen production apparatus such that the system is configured to supply liquid nitrogen obtained from the medium-pressure column to the high-purity oxygen production apparatus in order to replenish refrigeration required for operation of the high-purity oxygen production apparatus, wherein the high-purity oxygen production system further comprises a nitrogen expansion line and a nitrogen expander, wherein the nitrogen expansion line is in fluid communication with an intermediate section of the nitrogen heat exchanger and is configured to receive nitrogen after being compressed in the nitrogen compressor by sending a partially cooled and pressurized nitrogen steam to the nitrogen expander to form an expanded nitrogen steam, wherein the nitrogen expansion line is further configured to send the expanded nitrogen steam to a cold end of the nitrogen heat exchanger and then recycled back to the nitrogen compressor.

2. The high-purity oxygen production system according to claim 1, wherein the main heat exchanger is configured to cool an air feed;

wherein the medium-pressure column is in fluid communication with a cold end of the main heat exchanger and is configured to receive the starting material air from the main heat exchanger, the medium-pressure column having a medium-pressure column bottom in which a first rectification liquid is collected, a medium-pressure column rectification portion for rectifying the starting material air, and a medium-pressure column top arranged above the medium-pressure column rectification portion, wherein the low-pressure column is arranged above the medium-pressure column, the low-pressure column having a low-pressure column bottom inside or below which is arranged a nitrogen condenser that is configured to condense a gas drawn from the medium-pressure column top and conducted by a circulation line and in which a second rectification liquid is collected, a low-pressure column rectification portion that is configured to rectify the first rectification liquid drawn from the medium-pressure column bottom, and a low-pressure column top to which is introduced at least a portion of a condensed stream condensed in the nitrogen condenser.

3. The high-purity oxygen production system according to claim 1, wherein the at least one high-purity oxygen rectification column further comprises:

a first oxygen rectification column having: a first oxygen rectification column rectification portion to which the second rectification liquid drawn from the low-pressure column bottom is introduced at an intermediate portion thereof or therebelow, a first oxygen rectification column bottom arranged below the first oxygen rectification column rectification portion, and a first oxygen rectification column top arranged above the first rectification column rectification portion;

a first oxygen evaporator arranged inside or below the first oxygen rectification column bottom, the first oxygen evaporator causing evaporation of a rectification liquid falling from the first oxygen rectification column rectification portion and the second rectification liquid which has been introduced;

a first oxygen condenser arranged inside or above the first oxygen rectification column top, wherein a first oxygen rectification gas drawn from an upper portion of the first oxygen rectification column rectification portion is cooled and liquefied by first liquid nitrogen condensed in the first oxygen evaporator, and is returned to the first oxygen rectification column rectification portion;

a second oxygen rectification column having a second oxygen rectification column bottom, a second oxygen rectification column rectification portion arranged above the second oxygen rectification column bottom, and a second oxygen rectification column top arranged above the second oxygen rectification column rectification portion;

a second oxygen evaporator arranged inside or below the second oxygen rectification column bottom, the second oxygen evaporator causing evaporation of a rectification liquid falling from the second oxygen rectification column rectification portion; and a second oxygen condenser arranged inside or above the second oxygen rectification column top, wherein the second oxygen condenser is configured to cool and liquefy a second oxygen rectification gas drawn from an upper portion of the second oxygen rectification column rectification portion by means of second liquid nitrogen sent to the second oxygen condenser, and returns the cooled and liquefied gas to the second oxygen rectification column rectification portion;

wherein the nitrogen heat exchanger is configured to receive a nitrogen-rich gas drawn from a space above the second oxygen condenser in the second oxygen rectification column top;

wherein the nitrogen compressor is configured to compress the nitrogen-rich gas drawn from the space above the second oxygen condenser in the second oxygen rectification column top;

wherein the high-purity oxygen production apparatus further comprises:

a line configured to recirculate a compressed nitrogen-rich gas compressed in the nitrogen compressor to the nitrogen heat exchanger, and introducing the nitrogen-rich gas to a space below the first oxygen evaporator in the first oxygen rectification column bottom; and a branch line which branches from the line and is configured to introduce the nitrogen-rich gas to a space below the second oxygen evaporator in the second oxygen rectification column bottom.

4. The high-purity oxygen production system according to claim 1, wherein the high-purity oxygen production apparatus comprises:

a high-purity oxygen tank for storing high-purity oxygen extracted in a liquid;

a pressurizer for evaporating a portion of high-purity liquid oxygen and pressurizing the high-purity liquid oxygen; and a liquid nitrogen buffer for storing liquid nitrogen.

5. The high-purity oxygen production system according to claim 1, wherein the high-purity oxygen production apparatus comprises:

a line for supplying liquid nitrogen from the medium-pressure column of the air separation apparatus to a liquid nitrogen buffer;

a liquid nitrogen flowmeter which is provided on the line and measures a flow rate of liquid nitrogen; and a control valve for controlling an amount measured by the liquid nitrogen flowmeter to a predetermined amount or a predetermined range.

6. The high-purity oxygen production system according to claim 1, wherein a high-purity oxygen liquid pressurized in a high-purity oxygen tank is introduced to the main heat exchanger in the air separation apparatus and evaporated, and extracted as high-purity oxygen gas.

7. A method for producing high-purity oxygen, the method comprising the steps of:

providing an air separation apparatus including a main heat exchanger, a medium-pressure column and a low-pressure column;

providing a high-purity oxygen production apparatus including a nitrogen compressor, a nitrogen heat exchanger and at least one high-purity oxygen rectification column;

supplying an oxygen-containing stream serving as a starting material for high-purity oxygen from the low-pressure column to the high-purity oxygen production apparatus; and supplying liquid nitrogen obtained from the medium-pressure column to the high-purity oxygen production apparatus in order to replenish cold heat required for operation of the high-purity oxygen production apparatus, wherein the high-purity oxygen production apparatus further comprises a nitrogen expansion line and a nitrogen expander, wherein the nitrogen expansion line is in fluid communication with an intermediate section of the nitrogen heat exchanger and is configured to receive nitrogen after being compressed in the nitrogen compressor by sending a partially cooled and pressurized nitrogen steam to the nitrogen expander to form an expanded nitrogen steam, wherein the nitrogen expansion line is further configured to send the expanded nitrogen steam to a cold end of the nitrogen heat exchanger and then recycled.

* * * * *